US009743205B2

(12) United States Patent
Stetson

(10) Patent No.: US 9,743,205 B2
(45) **Date of Patent: *Aug. 22, 2017**

(54) LOW-COST METHOD FOR TESTING THE SIGNAL-TO-NOISE RATIO OF MEMS MICROPHONES

(71) Applicant: Robert Bosch GmbH, Stuttgart (DE)

(72) Inventor: Philip Sean Stetson, Wexford, PA (US)

(73) Assignee: Robert Bosch GmbH, Stuttgart (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/339,267

(22) Filed: Oct. 31, 2016

(65) Prior Publication Data

US 2017/0048636 A1 Feb. 16, 2017

Related U.S. Application Data

(63) Continuation of application No. 14/590,763, filed on Jan. 6, 2015, now Pat. No. 9,485,599.

(51) Int. Cl.
*H04R 29/00* (2006.01)
*H04R 19/00* (2006.01)

(52) U.S. Cl.
CPC ..... *H04R 29/005* (2013.01); *H04R 29/004* (2013.01); *H04R 19/005* (2013.01); *H04R 2201/003* (2013.01); *H04R 2410/05* (2013.01)

(58) Field of Classification Search
CPC ..... H04R 29/004; H04R 29/005; H04R 2499/11; H04R 3/005; H04R 2430/23; H04R 2410/05; H04R 2201/403
USPC ..... 381/58, 59, 71.11, 71.12, 94.1–94.3; 702/48, 66, 69, 103, 104; 324/750.01, 324/614, 615
See application file for complete search history.

(56) References Cited

U.S. PATENT DOCUMENTS

| | | | |
|---|---|---|---|
| 5,703,797 | A | 12/1997 | Russell |
| 6,317,501 | B1 | 11/2001 | Matsuo |
| 8,219,394 | B2 | 7/2012 | Flaks et al. |
| 2011/0182436 | A1 | 7/2011 | Murgia et al. |

(Continued)

FOREIGN PATENT DOCUMENTS

| | | |
|---|---|---|
| WO | 2009/127568 | 10/2009 |

OTHER PUBLICATIONS

International Search Report and Written Opinion for Application No. PCT/US2016/012141 dated Apr. 28, 2016 (15 pages).

(Continued)

*Primary Examiner* — David Ton
(74) *Attorney, Agent, or Firm* — Michael Best & Friedrich LLP

(57) ABSTRACT

A method is provided for testing a MEMS microphone. The MEMS microphone includes a pressure sensor positioned within a housing and a pressure input port to direct acoustic pressure from outside the housing towards the pressure sensor. An acoustic pressure source provides acoustic pressure to the MEMS microphone. A reference microphone is positioned proximal to the MEMS microphone. An output signal of the MEMS microphone and an output signal of the reference microphone are compared. A common signal component is removed from the output signal of the MEMS microphone and the output signal of the MEMS microphone is analyzed for noise due to the construction of the device and for a signal-to-noise ratio of the device. Based on the noise signal and the signal-to-noise ratio, the MEMS microphone is rejected or accepted.

16 Claims, 4 Drawing Sheets

(56) References Cited

U.S. PATENT DOCUMENTS

| | | | |
|---|---|---|---|
| 2011/0226544 | A1 | 9/2011 | Viehmann |
| 2012/0185247 | A1 | 7/2012 | Tzirkel-Hancock et al. |
| 2012/0308047 | A1 | 12/2012 | Muza |
| 2013/0140656 | A1 | 6/2013 | Pahl |
| 2014/0079229 | A1 | 3/2014 | Doller et al. |
| 2014/0328489 | A1 | 11/2014 | Ziegler |
| 2015/0117654 | A1 | 4/2015 | John |

OTHER PUBLICATIONS

Anonymous: "AN4426 Application Note: Tutorial for MEMS microphones", Jan. 9, 2014, pp. 1-18. Retrieved rom the Internet: URL:http://www.st.com/st-web-ui/static/active/en/resource/technical/document/application_note/DM00103199.pdf.

Spalt et al., "A Background Noise Reduction Technique using Adaptive Noise Cancellation for Microphone Arrays," conference: 17th AIAA/CEAS Aeroacoustics Conference (32nd AIAA Aeroacoustics Conference), Portland, Oregon, Jun. 5-8, 2011 (16 pages).

LOW-COST METHOD FOR TESTING THE SIGNAL-TO-NOISE RATIO OF MEMS MICROPHONES

BACKGROUND

The present invention relates to methods of measuring the signal-to-noise ratio during manufacturing of a microelectromechanical (MEMs) microphone.

SUMMARY

In one embodiment, the invention provides a method of testing a microelectromechanical (MEMS) microphone. The MEMS microphone includes a pressure sensor positioned within a housing and a pressure input port to direct acoustic pressure from outside the housing toward the pressure sensor. Position a MEMS microphone with a MEMS microphone input proximal to an acoustic pressure source and position a reference microphone proximal to the MEMS microphone so that the reference microphone input receives approximately the same acoustic pressure as the MEMS microphone input. Power the MEMS microphone and the reference microphone with a power source. Compare a MEMS microphone output signal of the MEMS microphone with a reference microphone output signal of the reference microphone. Determine a common signal component, which is present in both the MEMS microphone output signal and the reference microphone output signal, based on the comparison between the MEMS microphone output signal and the reference microphone output signal. Remove the common signal component from the MEMS microphone output signal and after removing the common signal component, determine a noise level in the MEMS microphone output signal. Then determine if the noise level exceeds a threshold value and if the noise level exceeds the threshold value, reject the MEMS microphone.

In another embodiment, the invention provides a microelectromechanical (MEMS) microphone testing system including a MEMS microphone with a MEMS microphone input and a MEMS microphone output. Also included is an acoustic pressure source and a reference microphone with a reference microphone output. A microphone interface is configured to electrically connect to the MEMS microphone output and the reference microphone output. A control unit includes a processor, a noise cancellation module, a memory, and an input/output interface. The control unit is configured to compare a MEMS microphone output signal of the MEMS microphone with a reference microphone output signal of the reference microphone and determine a common signal component in the MEMS microphone output signal and the reference microphone output signal, based on the comparison between the MEMS microphone output signal and the reference microphone output signal. The control unit removes the common signal component from the MEMS microphone output signal and after removing the common signal component, determines a noise level in the MEMS microphone output signal. The control unit determines if the noise level exceeds a threshold value, and if the noise level exceeds the threshold value, rejects the MEMS microphone.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

It should be noted that a plurality of hardware and software based devices, as well as a plurality of different structural components may be used to implement the invention. In addition, it should be understood that embodiments of the invention may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software (e.g., stored on non-transitory computer-readable medium) executable by one or more processors. As such, it should be noted that a plurality of hardware and software based devices, as well as a plurality of different structural components may be utilized to implement the invention. For example, "control units" and "controllers" described in the specification can include one or more processors, one or more memory modules including non-transitory computer-readable medium, one or more input/output interfaces, and various connections (e.g., a system bus) connecting the components.

The background noise (i.e., ambient noise) can adversely affect a MEMS microphone testing system. Background noise includes, for example, traffic, conversations, movement, facility equipment, vibrations, etc. The background noise can be consistent through the testing process or can have rapid changes in amplitude. The sum of all the background noise is called a noise floor and can be measured in decibels (dBs). Since MEMS microphones have high signal-to-noise ratios, measurement of the noise component of the output signal of the MEMS microphone can be washed out by background noise. Generally, during MEMS microphone testing, lowering the noise floor is desirable to achieve accurate testing of the MEMS microphones. However, acoustic and vibration isolation for the microphone testing system can be expensive and may not reduce the noise floor to acceptable levels. The microphone testing system of FIG. 1 is designed to alleviate the effects of background noise during testing.

Figure 1:
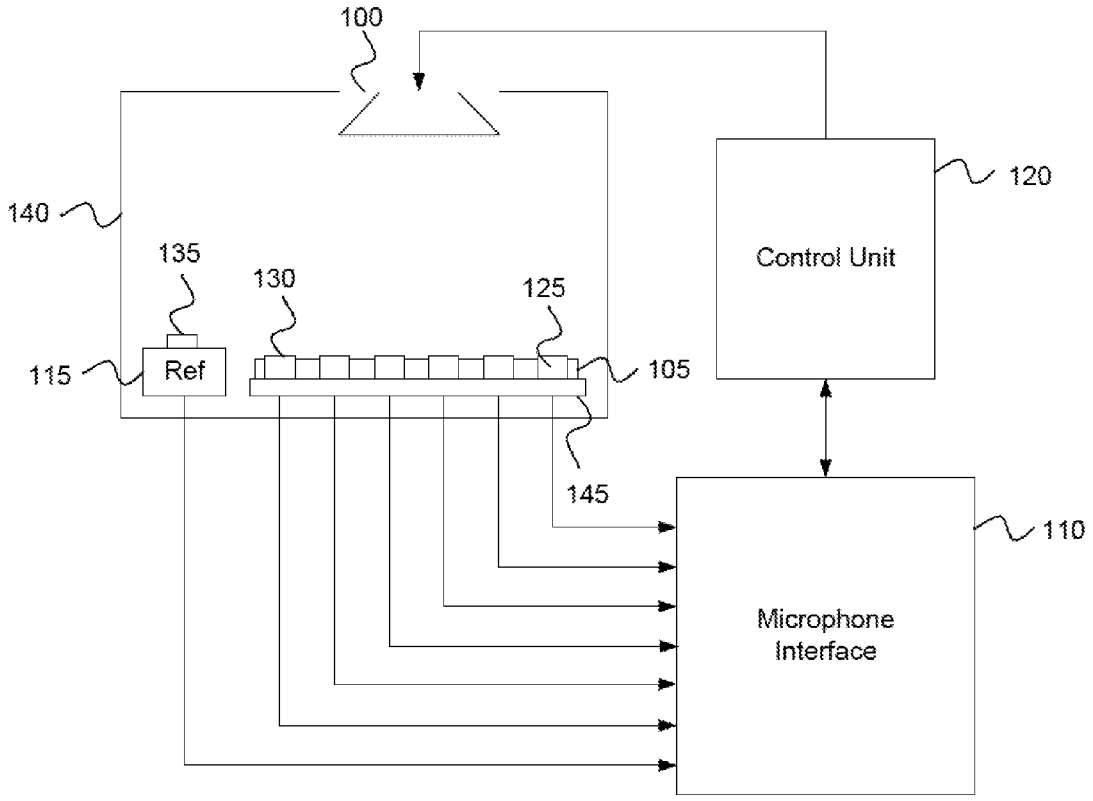
FIG. 1 is a block diagram of a microphone testing system.

FIG. 1 illustrates an example of a microphone testing system 90 for testing the signal-to-noise ratio (SNR) of a plurality of microelectromechanical (MEMS) microphones. An acoustic pressure source 100 is positioned to output acoustic energy towards a MEMS microphone array 105. The microphone array 105 is electrically coupled to a microphone interface 110. Positioned proximal to the microphone array 105 is a reference microphone 115. The reference microphone 115 is connected to the microphone interface 110. The microphone interface 110 is connected to a control unit 120. The microphone array 105 includes a plurality of MEMS microphones 125. The microphone array 105 may include MEMS microphones 125 from various stages of manufacturing. For example, the microphone array 105 may include individual and completed MEMS microphones 125 that are grouped together on the microphone array 105. Conversely, the microphone array 105 may include MEMS microphones 125 positioned on a tray from a singulation process.

In some constructions, the reference microphone 115 and the acoustic pressure source 100 may be positioned inside a testing chamber 140. In this case, the microphone array 105 is positioned inside the testing chamber 140 and electrically connected to a connection board 145. The connection board 145 provides pins (e.g., pogo pins) to establish electrical connections to the MEMS microphones 125. The connection board 145 is electrically coupled to the microphone interface 110 and configured to transmit output signals from the MEMS microphones 125 to the microphone interface 110.

In some constructions, the acoustic pressure source 100 is a manually-adjusted device separate from the control unit 120. In other constructions, the acoustic pressure source 100 may receive a power signal and a control signal from the control unit 120. The acoustic pressure source 100 may include one or more speakers, a tone generator, or other sound generating devices. The acoustic pressure source 100 is able to sweep through a range of frequencies and able to sweep through a range of amplitudes during microphone testing. Ideally, the acoustic pressure source 100 is positioned such that the amplitude and frequency of the testing tone is equally distributed over the microphone array 105. The ideal position may be approximated by positioning the acoustic pressure source 100 centrally over the middle of the microphone array 105 with an output of the acoustic pressure source 100 facing towards the center of the microphone array 105. This construction creates a direct acoustic path to the microphone array 105.

The reference microphone 115 is positioned proximal to the microphone array 105 so that the reference microphone 115 senses, as close as possible, the same acoustic energy sensed by the microphone array 105. In some constructions, the reference microphone 115 is positioned in the center of the microphone array 105 with its reference input 135 positioned in the same direction as the input ports 130 of the microphone array 105. Such positioning captures equivalent acoustic energy at the reference input 135 of the reference microphone 115 as seen at the input ports 130 of the microphone array 105. In some constructions, the reference microphone 115 includes several individual microphones positioned at a plurality of locations around the microphone array 105 and the reference microphone 115 is configured to sense an average level of acoustic energy around the microphone array 105. The microphone array 105, as well as the reference microphone 115, also sense acoustic energy that is not emitted from the acoustic pressure source 100 (i.e., background noise). The reference microphone 115 is a well-controlled and calibrated component designed to accurately sense the background noise in the testing environment.

The microphone interface 110 receives an output signal from the reference microphone 115, as well as, output signals from each of the MEMS microphones 125 in the microphone array 105. The microphone interface 110 includes processing equipment to convert output signals from the reference microphone 115 and the MEMS microphones 125 to signals for analysis by the control unit 120. In one construction, the processing equipment includes a multiplexer. Digital signals may be sent to the control unit 120 as a serial communication or the digital signal may be sent to the control unit 120 as parallel components representing each of the MEMS microphones 125 within the microphone array 105.

Figure 2:
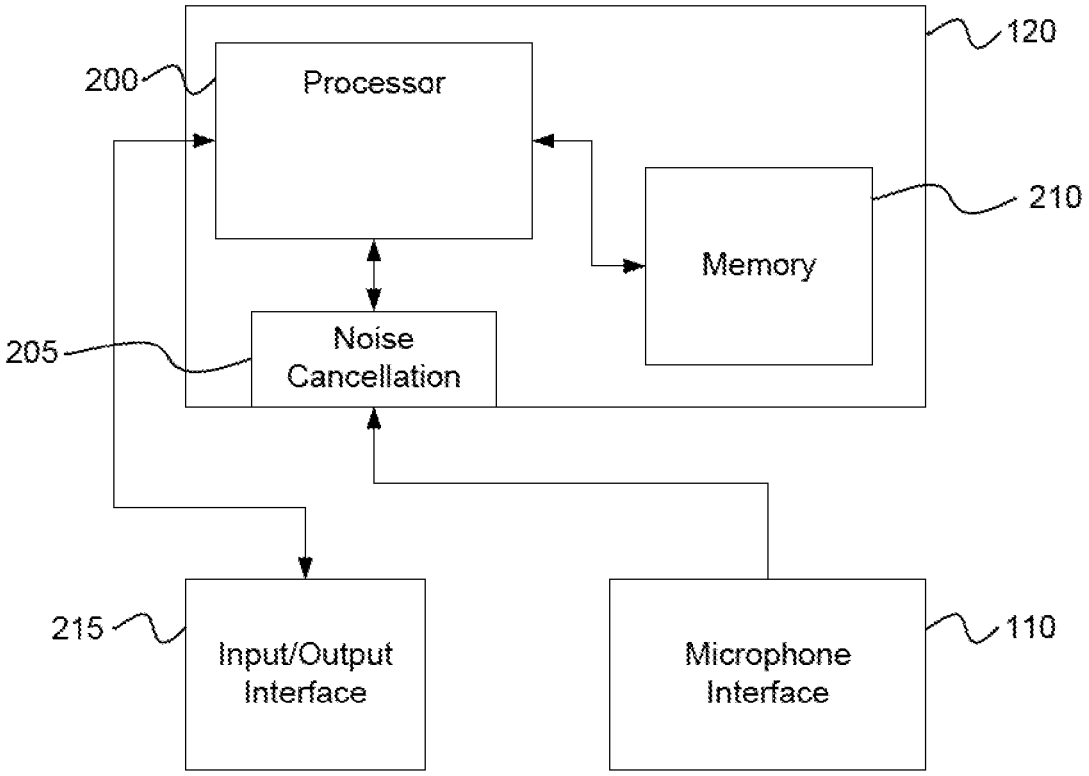
FIG. 2 is a block diagram illustrating details of the control unit of FIG. 1.

One construction of the control unit 120 is illustrated in FIG. 2. The control unit 120 includes a processor 200, a noise cancellation module 205, and a memory 210. The processor 200 is electrically and/or communicatively connected to a variety of modules or components of the control unit 120. For example, the illustrated processor 200 is connected to the memory 210 and the input/output interface 215. The control unit 120 includes combinations of hardware and software that are operable to, among other things, control the operation of the acoustic pressure source 100 and control the input/output interface 215. The control unit 120 is configurable through the input/output interface 215. The control unit 120 includes a plurality of electrical and electronic components that provide power, operational control, and protection to the components and modules within the control unit 120 and/or the microphone testing system 90.

The memory 210 includes, for example, a program storage area and a data storage area. The program storage area and the data storage area can include combinations of different types of memory 210, such as read-only memory ("ROM") and non-volatile random access memory ("RAM"). The memory 210 stores, among other things, information about the performance of the MEMS microphones 125 in the microphone array 105. For example, the memory 210 stores the signal-to-noise ratios of each of the MEMS microphones 125 and threshold values for acceptable signal-to-noise ratios at a plurality of frequencies and amplitudes.

The processor 200 is connected to the memory 210 and executes software instructions that are capable of being stored in a RAM of the memory 210 (e.g., during execution), a ROM of the memory 210 (e.g., on a generally permanent basis), or another non-transitory computer readable medium such as another memory or a disc. Software included in the implementation of the microphone testing system 90 can be stored in the memory 210 of the control unit 120. The software includes, for example, firmware, one or more applications, program data, filters, rules, one or more program modules, and other executable instructions. The control unit 120 is configured to retrieve from memory and execute, among other things, instructions related to the control processes and methods described herein. In other constructions, the control unit 120 includes additional, fewer, or different components.

A power supply supplies a nominal AC or DC voltage to the control unit 120 or other components or modules of the microphone testing system 90. The power supply is also configured to supply lower voltages to operate circuits and components within the control unit 120 or microphone testing system 90. In other constructions, the control unit 120 or other components and modules within the microphone testing system 90 are powered by one or more batteries or battery packs, or another grid-independent power source (e.g., a generator, a solar panel, etc.).

The input/output interface 215 is used to control or monitor the microphone testing system 90. For example, the input/output interface 215 is operably coupled to the control unit 120 to control the configuration of the microphone testing system 90. The input/output interface 215 includes a combination of digital and analog input or output devices required to achieve a desired level of control and monitoring for the microphone testing system 90. For example, the input/output interface 215 includes a display and input devices such as touch-screen displays, a plurality of knobs, dials, switches, buttons, etc. The input/output interface 215 can also be configured to display conditions or data associated with the microphone testing system 90 in real-time or substantially real-time.

The noise cancellation module is configured to perform noise cancellation on the output signals from the MEMS microphones 125 in the microphone array 105. In one construction, the noise cancellation module uses hardware designed to perform the signal processing. For example, the hardware includes circuitry for adaptive noise cancellation including one or more adaptive filters. In another construction, the noise cancellation module performs noise cancellation with software rather than hardware. In this construction, the memory 210 stores instructions that, when run on the processor 200, cause the control unit 120 to process the MEMS microphone output signals through algorithms designed to reduce the effects of background noise. For example, the control unit 120 may use well-known algorithms, such as, for example, least-mean-square (LMS) or recursive least squares (RLS) algorithms. The noise cancellation module 205 receives an output signal from the reference microphone 115 indicative of the background noise present at the input of the MEMS microphones 125 in the microphone array 105.

In one construction, the noise cancellation module 205 compares the output of the reference microphone 115 with the outputs of each of the MEMS microphones 125 in the microphone array 105 and identifies a common signal component that is common to all of these output signals. The noise cancellation module 205 cancels the common signal component from the outputs of the MEMS microphones 125 in the microphone array 105 before testing the signal-to-noise ratio of the MEMS microphones 125. In another construction, the noise cancellation module 205 compares the output of the reference microphone 115 with an average signal of the output signals from the MEMS microphones 125. In this construction, the subtracted common signal component is the signal that is common to the reference microphone 115 and the average signal.

Figure 3:
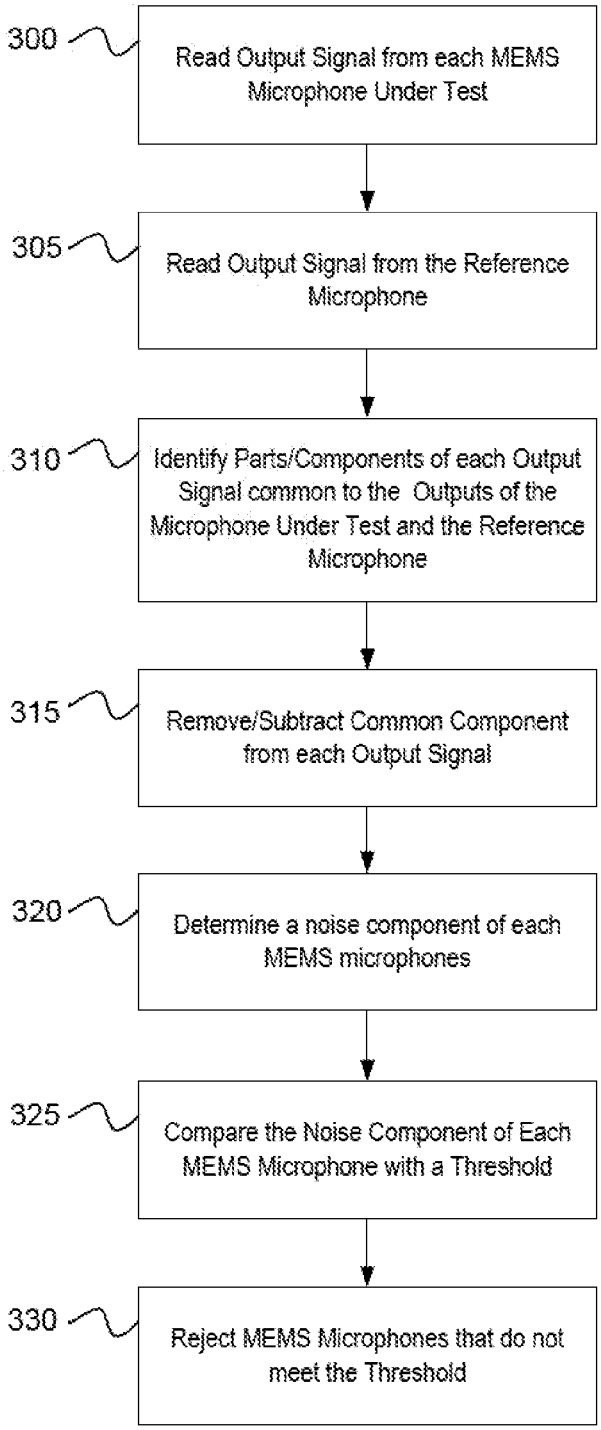
FIG. 3 is a flowchart illustrating a method of determining a noise component of an output signal of a MEMS microphone by using the microphone testing system of FIG. 1.

FIG. 3 illustrates a method of determining the noise signal of the MEMS microphones 125 using the microphone testing system 90 of FIG. 1. The noise signal of the MEMS microphones 125 is determined without any applied sound (i.e., only background noise). The control unit 120 reads the output signal from the microphone interface 110 representative of the output signals of each of the MEMS microphones 125 in the microphone array 105 (step 300). The control unit 120 also reads the output signal from the microphone interface 110 representative of the output signal from the reference microphone 115 (step 305). The noise cancellation module 205 identifies signal components of the output of the MEMS microphones 125 and signal components of the output of the reference microphone 115 that are common to each signal (step 310). The noise cancellation module 205 removes or subtracts the common signal components from the output signal of each of the MEMS microphones 125 on the microphone array 105 (step 315). After the common signal components are removed, the control unit 120 determines the noise component of each of the MEMS microphones 125 on the microphone array 105 (step 320). The control unit 120 compares the noise component against a threshold value (step 325). The control unit 120 identifies and rejects the MEMS microphones 125 that have a noise component greater than a threshold (step 330).

Figure 4:
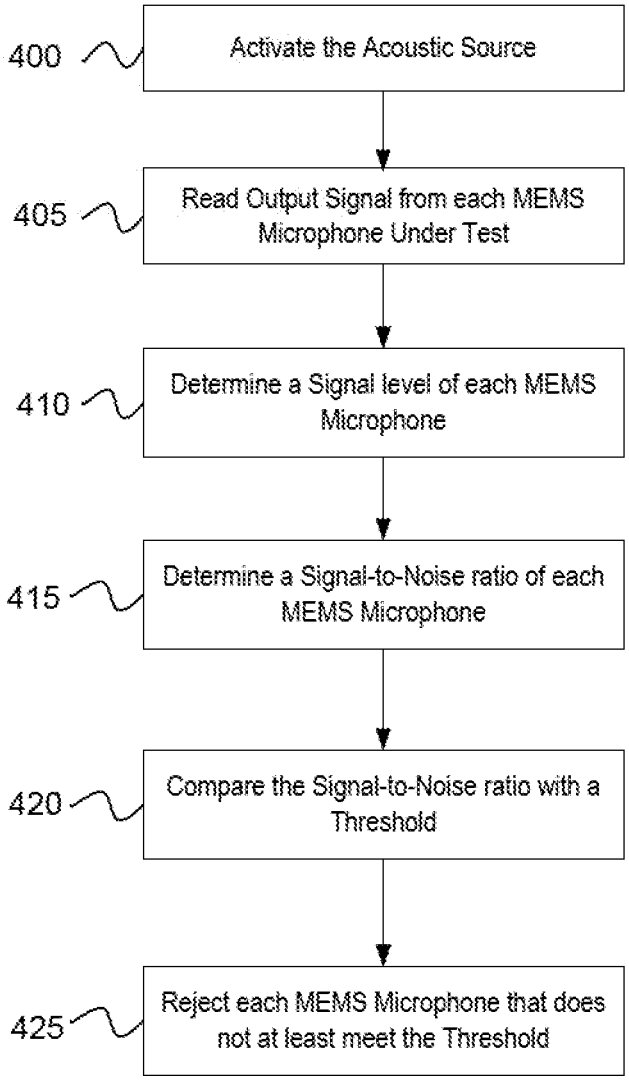
FIG. 4 is a flowchart illustrating a method of determining the signal-to-noise ratio of a MEMS microphone by using the microphone testing system of FIG. 1.

FIG. 4 illustrates a method of determining the signal-to-noise ratio of the MEMS microphones 125 using the microphone testing system 90 of FIG. 1. The control unit 120 activates the acoustic pressure source 100 (step 400). The control unit 120 reads the output signal from the microphone interface 110 representative of the output signals of each of the MEMS microphones 125 in the microphone array 105 (step 405). The control unit 120 determines the level and quality of the output signal from the microphone interface 110 (step 410). The control unit 120 calculates a signal-to-noise ratio (SNR) for each of the MEMS microphones 125 based on the output signal without an active acoustic pressure source and the output signal with an active acoustic pressure source (step 415). The control unit 120 compares the signal-to-noise ratio to a threshold value (step 420). The control unit 120 identifies and rejects the MEMS microphones 125 that have a signal-to-noise ratio that is below the minimum SNR threshold (step 425). The MEMS microphones 125 that pass testing are removed from the microphone array 105 and prepared for shipment. The MEMS microphones 125 that fail testing are removed from the microphone array 105 and discarded.

It should be noted that the noise testing in FIG. 3 and the SNR testing in FIG. 4 do not have to be performed in order. Likewise, the steps in FIGS. 3 and 4 do not have to be performed in order. For example, the control unit 120 can read the output signal from the reference microphone 115 before reading the outputs from the MEMS microphones 125 (steps 300 and 305). Additionally, in some embodiments, steps 400 through 425 are repeated using a plurality of testing tones at various frequencies and amplitudes. In this case, the SNR for each of the MEMS microphones 125 is tested at each frequency. The SNR of each of the MEMS microphones 125 is compared to a threshold value for that frequency. Each of the MEMS microphones 125 is rejected if it does not meet the multiple thresholds.

Thus, the invention provides, among other things, a testing arrangement that allows for a method of detecting the signal-to-noise ratio while suppressing background noise. Various features and advantages of the invention are set forth in the following claims.

What is claimed is:

1. A method of testing a microelectromechanical (MEMS) microphone, the MEMS microphone including a pressure sensor positioned within a housing and a pressure input port to direct acoustic pressure from outside the housing toward the pressure sensor, the method comprising the acts of:

positioning the MEMS microphone and a reference microphone proximal to an acoustic pressure source so that the reference microphone input receives approximately the same acoustic pressure as the MEMS microphone input;

powering the MEMS microphone and the reference microphone;

comparing a MEMS microphone output signal of the MEMS microphone with a reference microphone output signal of the reference microphone;

determining a common signal component, which is present in both the MEMS microphone output signal and the reference microphone output signal, based on the comparison between the MEMS microphone output signal and the reference microphone output signal;

removing the common signal component from the MEMS microphone output signal;

after removing the common signal component, determining a noise level in the MEMS microphone output signal;

determining if the noise level exceeds a threshold value; and if the noise level exceeds the threshold value, rejecting the MEMS microphone.

2. The method of claim 1, wherein positioning the MEMS microphone with a MEMS microphone input proximal to the acoustic pressure source, further includes positioning a MEMS microphone array proximal to the acoustic pressure source, wherein the MEMS microphone array includes the MEMS microphone.

3. The method of claim 2, wherein the MEMS microphone array includes a plurality of MEMS microphones, further comprising the act of:

positioning the MEMS microphone array inside a testing chamber, wherein the testing chamber includes the acoustic pressure source, the reference microphone, and a connection board.

4. The method of claim 1, further comprising the acts of:

applying an acoustic pressure to the MEMS microphone with the acoustic pressure source;

generating a plurality of tones that vary in frequency and amplitude with the acoustic pressure source; and analyzing the MEMS microphone output signal for each of the plurality of tones.

5. The method of claim 4, further comprising the acts of:

determining a signal-to-noise ratio of the MEMS microphone based on the MEMS microphone output signal and the frequency and amplitude of the plurality of tones;

comparing the signal-to-noise ratio to a minimum signal-to-noise ratio threshold; and if the signal-to-noise ratio is below the minimum signal-to-noise ratio threshold, rejecting the MEMS microphone.

6. The method of claim 1, wherein removing the common signal component from the MEMS microphone output signal is performed by hardware.

7. The method of claim 1, wherein removing the common signal component from the MEMS microphone output signal is performed by software.

8. The method of claim 1, wherein the MEMS microphone and the reference microphone are powered by a power source.

9. A microelectromechanical (MEMS) microphone testing system comprising a control unit including a processor and a memory, wherein the control unit is configured to perform the acts of claim 1.

10. A microelectromechanical (MEMS) microphone testing system comprising:

a MEMS microphone including a MEMS microphone input and a MEMS microphone output;

an acoustic pressure source that generates an acoustic pressure;

a reference microphone including a reference microphone output;

a microphone interface configured to electrically connect to the MEMS microphone output and the reference microphone output; and a control unit configured to:

compare a MEMS microphone output signal of the MEMS microphone with a reference microphone output signal of the reference microphone;

determine a common signal component in the MEMS microphone output signal and the reference microphone output signal, based on the comparison between the MEMS microphone output signal and the reference microphone output signal;

remove the common signal component from the MEMS microphone output signal;

after removing the common signal component, determine a noise level in the MEMS microphone output signal;

determine if the noise level exceeds a threshold value; and if the noise level exceeds the threshold value, reject the MEMS microphone.

11. The system of claim 10, wherein the MEMS microphone is coupled to a MEMS microphone array that includes a plurality of MEMS microphones such that the plurality of MEMS microphones are tested with the MEMS microphone.

12. The system of claim 11, wherein the plurality of MEMS microphones includes a plurality of MEMS microphone outputs, and further comprising:

a testing chamber, wherein the testing chamber includes the acoustic pressure source, the reference microphone, and a connection board.

13. The system of claim 10, wherein the control unit is further configured to:

generate an acoustic pressure source signal that controls the acoustic pressure source, which generates a plurality of tones that vary in frequency and amplitude;

analyze the MEMS microphone output signal for each of the plurality of tones;

set a plurality of frequency-dependent minimum thresholds; and reject the MEMS microphone when a signal-to-noise ratio is below any of the plurality of frequency-dependent minimum thresholds.

14. The system of claim 10, wherein the control unit includes a processor, a noise cancellation module, a memory, and an input/output interface, wherein the noise cancellation module is configured to remove the common signal component from the MEMS microphone output signal, wherein the noise cancellation module includes hardware.

15. The system of claim 10, wherein the control unit includes a processor, a noise cancellation module, a memory, and an input/output interface, wherein the noise cancellation module is configured to remove the common signal component from the MEMS microphone output signal, wherein the noise cancellation module includes software.

16. The system of claim 10, wherein the control unit is further configured to determine a signal-to-noise ratio of the MEMS microphone based on the MEMS microphone output signal and the acoustic pressure and compare the signal-to-noise ratio to a minimum signal-to-noise ratio threshold.

* * * * *